US010214951B2

(12) United States Patent
Liang

(10) Patent No.: US 10,214,951 B2
(45) Date of Patent: Feb. 26, 2019

(54) DOOR HINGE HAVING DAMPING FUNCTION

(71) Applicant: Yelin Liang, Guangdong (CN)

(72) Inventor: Yelin Liang, Guangdong (CN)

( * ) Notice: Subject to any disclaimer, the term of this patent is extended or adjusted under 35 U.S.C. 154(b) by 0 days.

(21) Appl. No.: 15/576,688

(22) PCT Filed: Dec. 1, 2016

(86) PCT No.: PCT/CN2016/108224
§ 371 (c)(1),
(2) Date: Nov. 22, 2017

(87) PCT Pub. No.: WO2017/148192
PCT Pub. Date: Sep. 8, 2007

(65) Prior Publication Data

US 2018/0135344 A1 May 17, 2018

(30) Foreign Application Priority Data

Mar. 4, 2016 (CN) ..... 2016 1 0122737

(51) Int. Cl.

| | |
|---|---|
| ***E05F 5/00*** | (2017.01) |
| ***E05F 3/20*** | (2006.01) |
| ***E05D 3/14*** | (2006.01) |
| ***E05F 1/12*** | (2006.01) |
| *E05F 5/10* | (2006.01) |
| *E05D 7/12* | (2006.01) |
| *E05D 11/10* | (2006.01) |

(52) U.S. Cl.
CPC ..... *E05F 5/006* (2013.01); *E05D 3/142* (2013.01); *E05F 1/1215* (2013.01); *E05F 3/20* (2013.01); *E05D 7/125* (2013.01); *E05D 11/1021* (2013.01); *E05F 5/10* (2013.01); *E05Y 2201/256* (2013.01); *E05Y 2201/264* (2013.01); *E05Y 2201/412* (2013.01); *E05Y 2201/484* (2013.01); *E05Y 2900/20* (2013.01)

(58) Field of Classification Search
CPC . E05F 1/1215; E05F 3/20; E05F 5/006; E05F 5/10; E05D 3/142
See application file for complete search history.

(56) References Cited

U.S. PATENT DOCUMENTS 2,940,116 A * 6/1960 Salice ..... E05D 5/08 16/291
6,553,617 B1 * 4/2003 Salice ..... E05F 5/02 16/82

(Continued)

*Primary Examiner* — Jeffrey O'Brien

(57) ABSTRACT

A door hinge having a damping function, comprising a housing, a first rotating shaft, a second rotating shaft, a U-shaped rotating shaft, a hinge cup, a linkage member, a torsion spring, a connector, a supporting structure, and a damping structure; one end of the linkage member is rotationally provided in the housing by means of the first rotating shaft, and the other end of the linkage member is rotationally connected to the hinge cup by means of one arm of the U-shaped rotating shaft; one end of the connector is rotationally provided in the housing by means of the second rotating shaft, and the other end of the connector is rotationally connected to the hinge cup by means of the other arm of the U-shaped rotating shaft; the torsion spring is fitted over the second rotating shaft.

3 Claims, 7 Drawing Sheets

(56) References Cited

U.S. PATENT DOCUMENTS 6,684,453 B2 * 2/2004 Wang ..... E05F 5/006 16/54
6,715,183 B1 * 4/2004 Lautenschlager ... E05D 11/1021 16/280
7,096,535 B2 * 8/2006 Lin ..... E05D 11/1021 16/286
7,562,416 B2 * 7/2009 Lautenschlager ..... E05D 3/142 16/286
7,712,185 B2 * 5/2010 Pyo ..... E05F 5/006 16/250
7,966,696 B2 * 6/2011 Krammer ..... E05F 5/006 16/286
8,601,644 B1 * 12/2013 Chen ..... E05F 5/006 16/286
8,713,760 B2 * 5/2014 Krudener ..... E05D 3/16 16/370
9,021,656 B2 * 5/2015 Brunnmayr ..... E05F 5/006 16/54
9,045,925 B2 * 6/2015 Salice ..... E05F 5/006
9,115,525 B2 * 8/2015 Zimmer ..... E05F 5/006
9,169,681 B2 * 10/2015 Cooper ..... E05D 3/14
9,556,660 B2 * 1/2017 Svara ..... E05F 5/006
9,617,773 B2 * 4/2017 Cooper ..... E05D 3/14
9,719,284 B2 * 8/2017 Chen ..... E05F 5/006
9,777,525 B2 * 10/2017 Salice ..... E05D 3/16
10,060,169 B2 * 8/2018 Chen ..... E05D 7/0407
10,081,975 B2 * 9/2018 Cooper ..... E05F 5/027
2005/0248246 A1 * 11/2005 Ger ..... E05D 3/142 312/334.47
2013/0180081 A1 * 7/2013 Salice ..... E05F 1/10 16/64
2013/0239363 A1 * 9/2013 apur ..... E05F 5/006 16/50
2015/0330128 A1 * 11/2015 Ng ..... E05D 3/16 16/65
2016/0273258 A1 * 9/2016 Pecar ..... E05F 5/006
2017/0022744 A1 * 1/2017 Migli ..... E05F 5/006
2017/0138106 A1 * 5/2017 Stuke ..... E05D 11/1021
2017/0292307 A1 * 10/2017 Hirtsiefer ..... E05D 3/16
2017/0306680 A1 * 10/2017 Zetti ..... E05F 3/20
2017/0314310 A1 * 11/2017 Dubach ..... E05F 1/1016
2017/0350179 A1 * 12/2017 Salice ..... E05F 5/006
2018/0087307 A1 * 3/2018 Hammerer ..... E05D 3/06
2018/0216385 A1 * 8/2018 Rodriguez Rodriguez ..... E05F 3/20
2018/0252016 A1 * 9/2018 Salice ..... E05D 3/142

* cited by examiner

DOOR HINGE HAVING DAMPING FUNCTION

TECHNICAL FIELD OF THE INVENTION

The present invention relates to the technical field of hinges, and more particularly, to a door hinge having a damping function.

BACKGROUND OF THE INVENTION

A traditional door hinge having a damping function usually comprises a housing, a first rotating shaft, a U-shaped rotating shaft, a hinge cup, a connector, a linkage member, a pusher and a damping cylinder. The piston rod of the damping cylinder is rotationally connected to the pusher, and the pusher is connected to the linkage member. Such a design has a very complicated structure. In particular, during use, the pusher is pulled by the piston rod of the cylinder to achieve a damping effect. In such a configuration, the piston rod fails to move in the axial direction, resulting in a greater friction between the piston rod and the sealing ring of the cylinder. Consequently, oil leakage can easily occur after a prolonged use, leading to problems such as hinge failure, difficult maintenance and low precision of the door hinge, resulting in a shortened life span.

SUMMARY OF THE INVENTION

The purpose of the present invention is to solve the shortcomings in the prior art and provide a door hinge having a damping function that enables the piston rod to move in the axial direction, can be easily assembled and maintained, has a simple structure, a long life-span and a high precision.

To achieve the above purpose, the present invention adopts the following technical solution: A door hinge having a damping function, comprising a housing, a first rotating shaft, a second rotating shaft, a U-shaped rotating shaft, a hinge cup, a linkage member, a torsion spring, a connector, a supporting structure, and a damping structure; one end of the linkage member is rotationally provided in the housing by means of the first rotating shaft, and the other end of the linkage member is rotationally connected to the hinge cup by means of one arm of the U-shaped rotating shaft; the hinge cup is fixed to the door plank; one end of the connector is rotationally provided in the housing by means of the second rotating shaft, and the other end of the connector is rotationally connected to the hinge cup by means of the other arm of the U-shaped rotating shaft; the torsion spring is fitted over the second rotating shaft, one end of the torsion spring is fixed to the linkage member, and the other end of the torsion spring abuts against the linkage member; the supporting structure is fixed to the linkage member; the damping structure is supported by the supporting structure and moves in the housing along with the supporting structure; a piston rod of the damping structure can abut against the torsion spring, thereby increasing the resetting resistance to the torsion spring.

The supporting structure comprises two left support arms and two right support arms. The left support arm coordinates with the right support arm to form a V-shaped mounting slot. The damping structure is disposed in the mounting slot formed between the left support arm and the right support arm.

The damping structure is a round-shaped cylinder body. The two sides of the round-shaped cylinder body are respectively provided with a locking block. The locking block is disposed in the mounting slot formed between the left support arm and the corresponding right support arm.

Compared with the prior art, the present invention has a simple structure, a long life-span and a high precision, and can be conveniently maintained.

DETAILED DESCRIPTION OF THE INVENTION

Drawings and detailed embodiments are combined hereinafter to elaborate the technical principles of the present invention.

The terms "front", "rear", "left", "right", and similar ones used below do not imply a required limitation in all embodiments of the present invention, but are used herein to describe relative direction or orientation in exemplary embodiments illustrated in the figures.

Furthermore, the terms "first" and "second" are merely used for descriptive purpose, which should neither be seen as an indication or implication of a relative importance, nor be seen as that of the quantity of the technical features.

Figure 1:
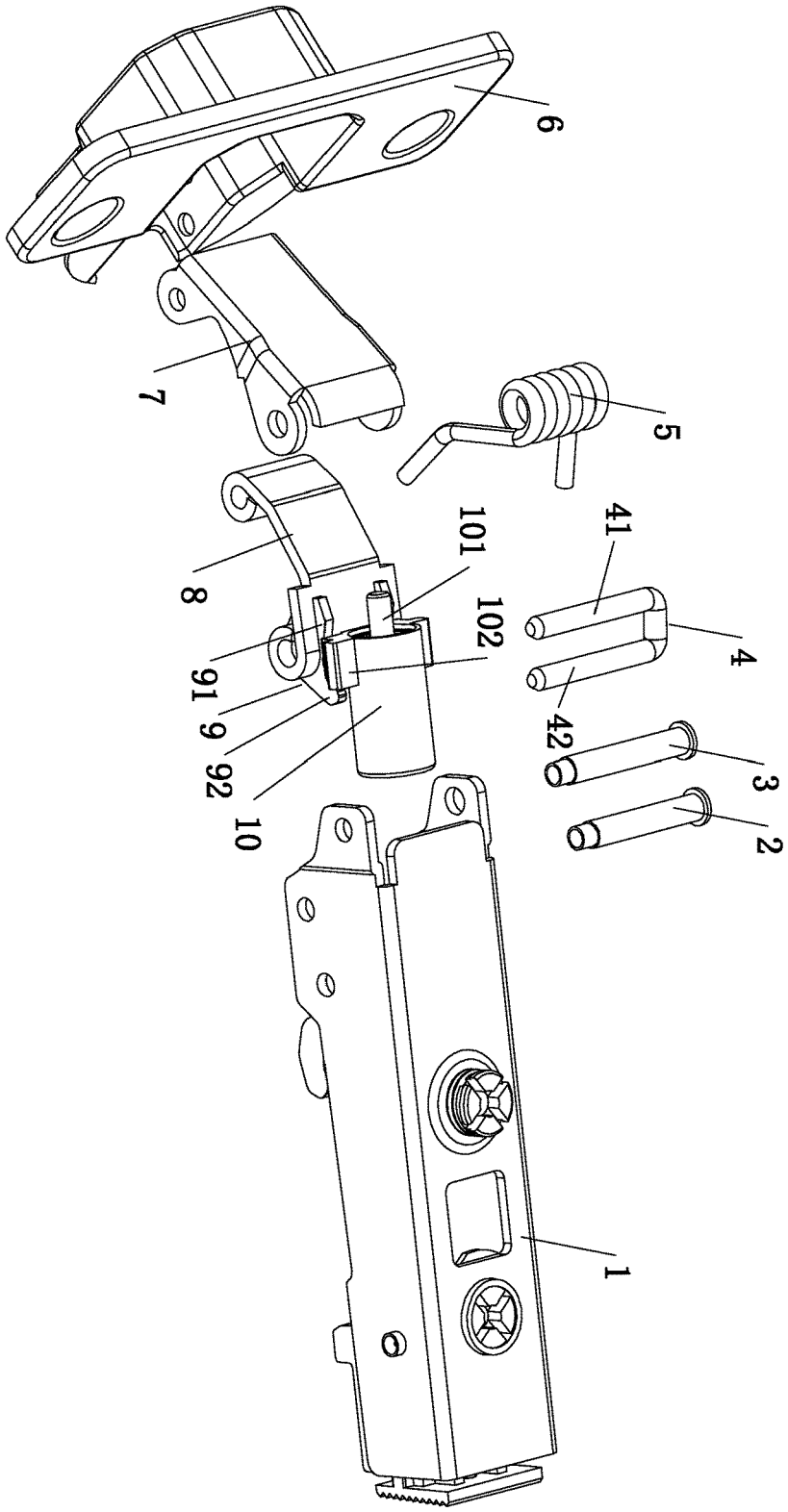
FIG. 1 is an exploded view of the present invention.
Figure 2:
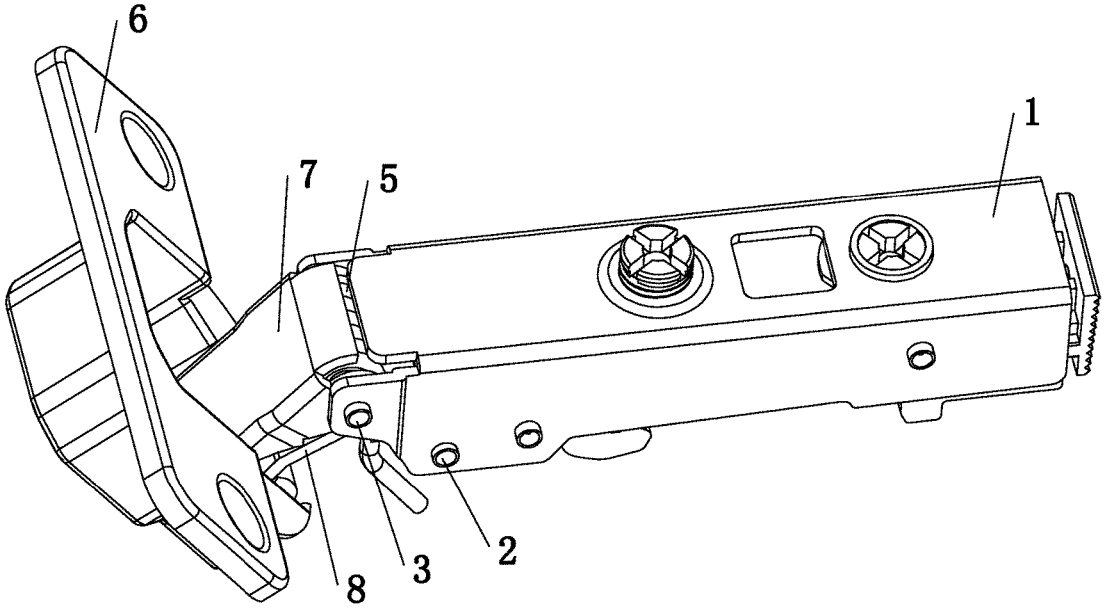
FIG. 2 is a three-dimensional diagram of the present invention.
Figure 3:
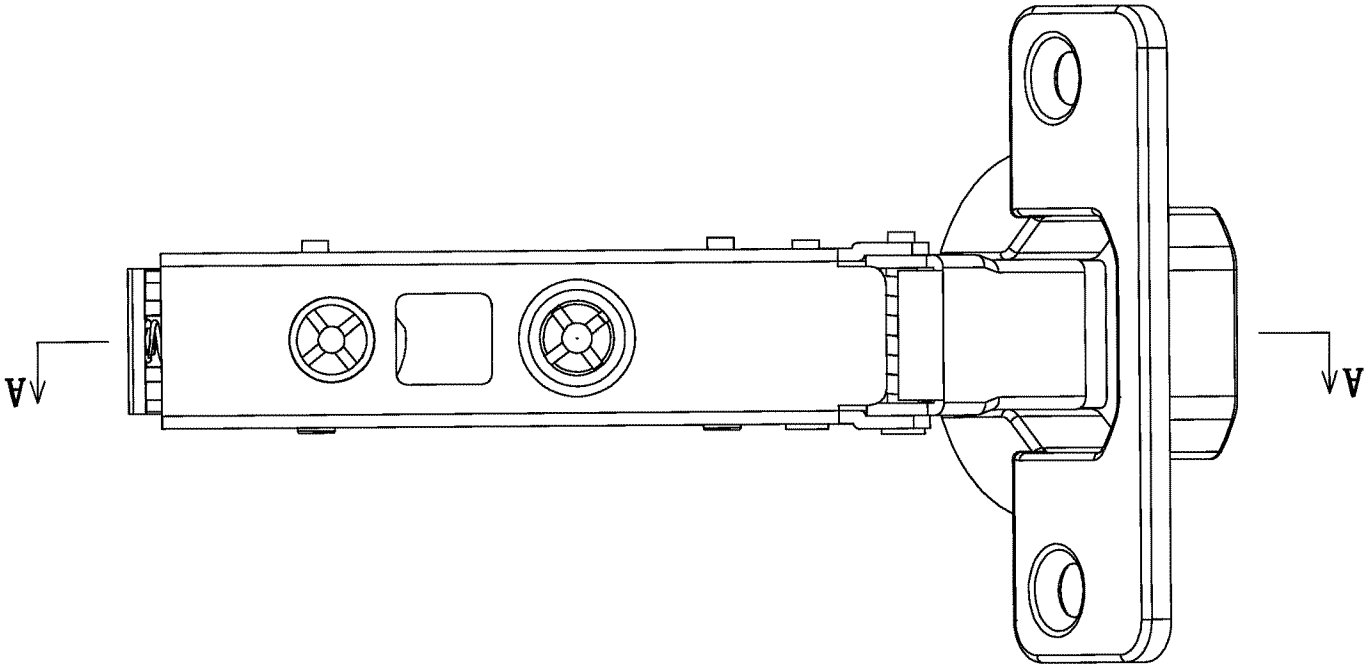
FIG. 3 is a top view of the present invention.
Figure 4:
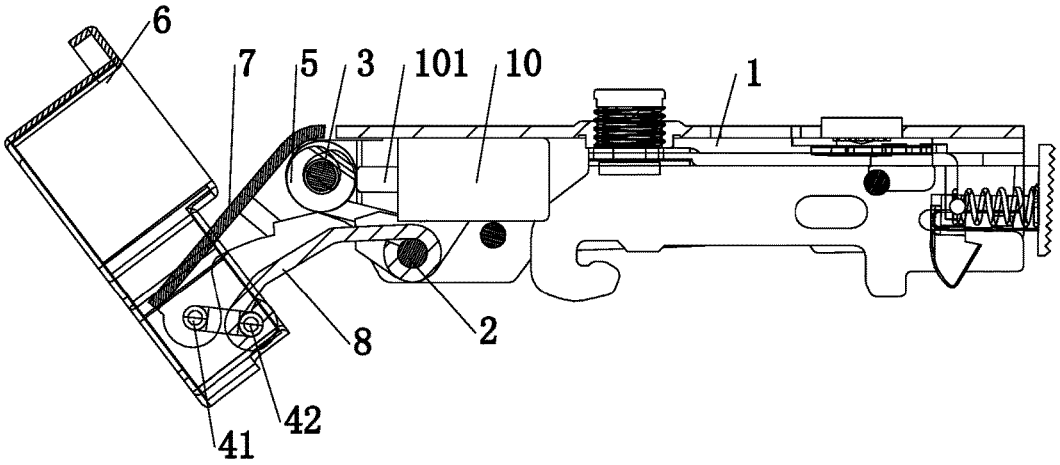
FIG. 4 is a sectional view illustrating one state of portion A-A in FIG. 3.
Figure 5:
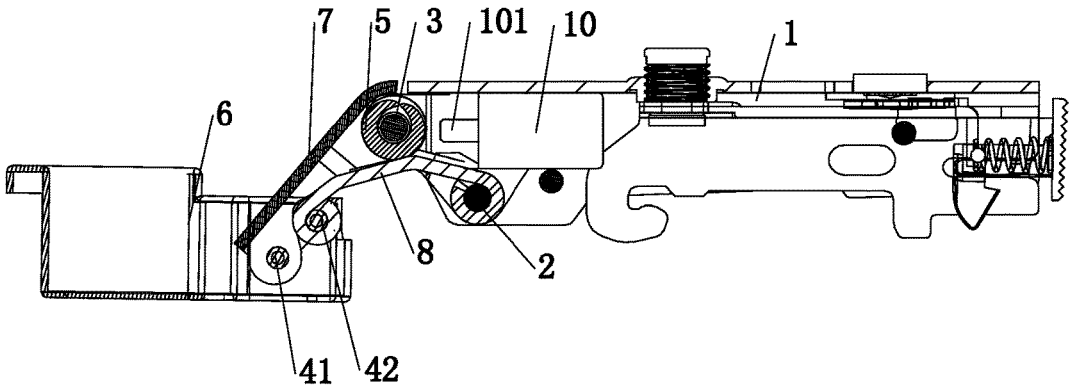
FIG. 5 is a sectional view illustrating another state of portion A-A in FIG. 3.
Figure 6:
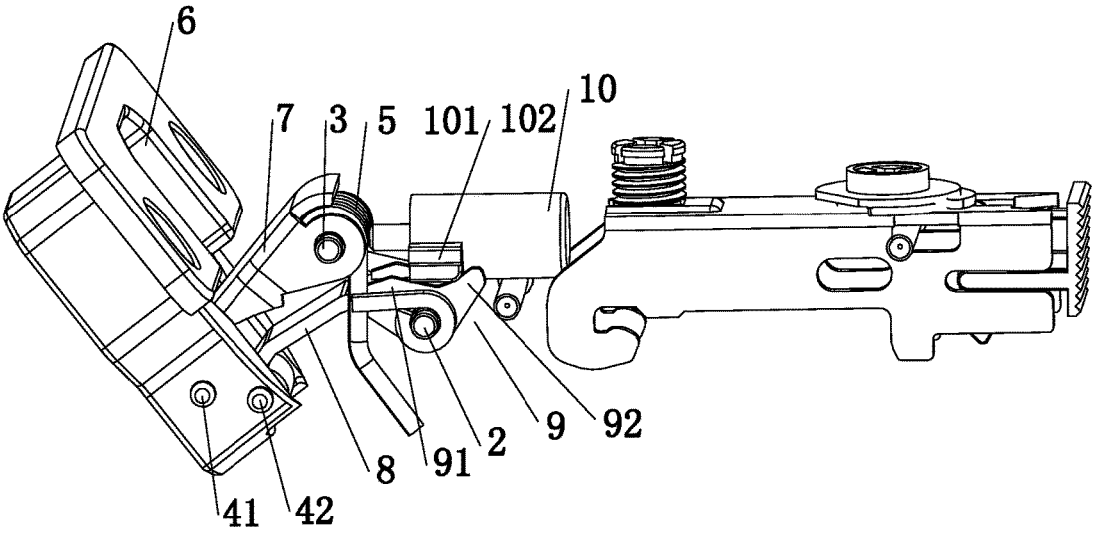
FIG. 6 is a three-dimensional diagram of the present invention without the housing.
Figure 7:
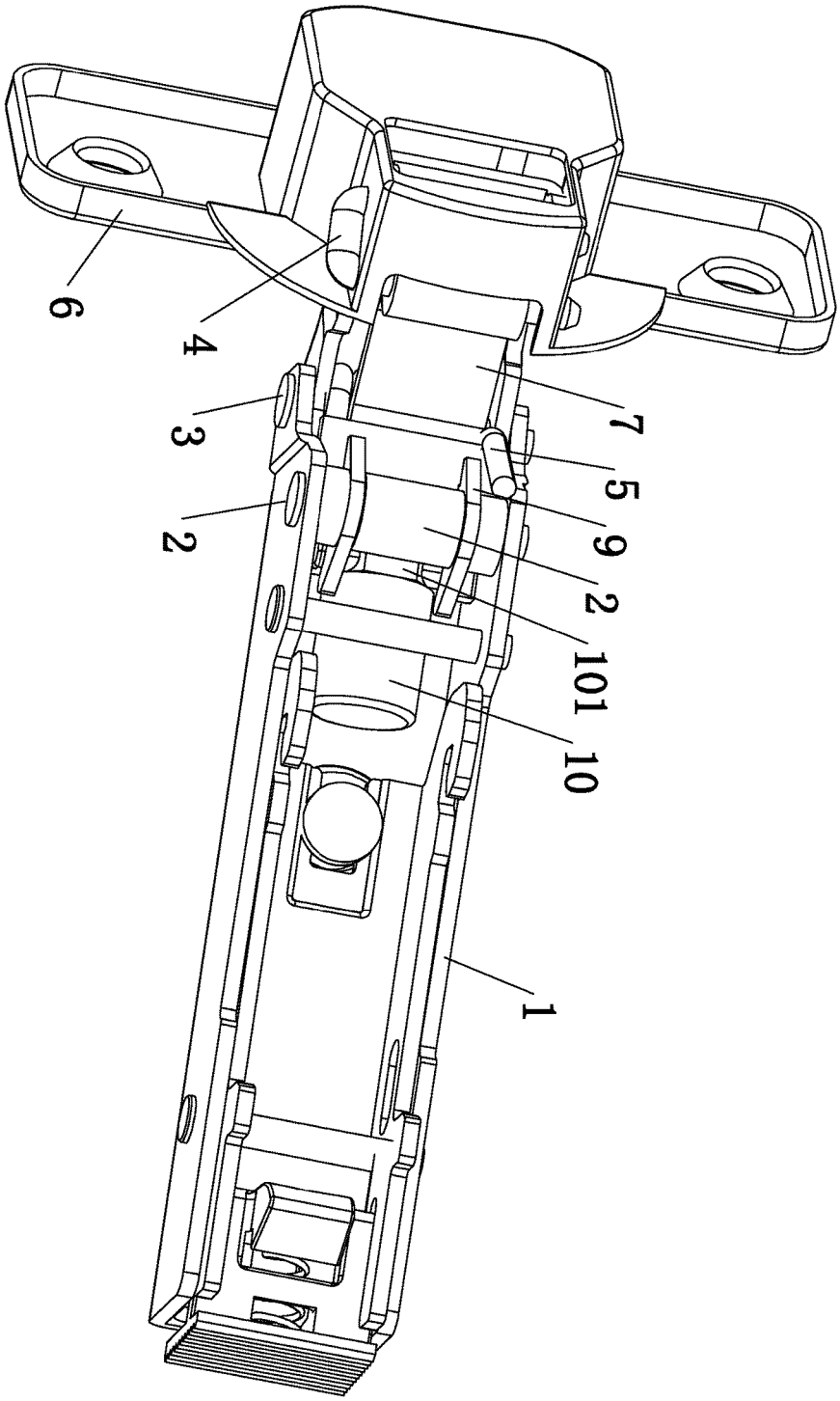
FIG. 7 is a bottom view of the present invention.

As shown in FIGS. 1-7, the door hinge having a damping function comprises a housing 1, a first rotating shaft 2, a second rotating shaft 3, a U-shaped rotating shaft 4, a hinge cup 6, a linkage member 8, a torsion spring 5, a connector 7, a supporting structure 9, and a damping structure 10; one end of the linkage member 8 is rotationally provided in the housing 1 by means of the first rotating shaft 2, and the other end of the linkage member 8 is rotationally connected to the hinge cup 6 by means of one arm 42 of the U-shaped rotating shaft 4; the hinge cup 6 is fixed to the door plank; one end of the connector 7 is rotationally provided in the housing 1 by means of the second rotating shaft 3, and the other end of the connector 7 is rotationally connected to the hinge cup 6 by means of the other arm 41 of the U-shaped rotating shaft 4; the torsion spring 5 is fitted over the second rotating shaft 3, one end of the torsion spring 5 is fixed to the linkage member 8, and the other end of the torsion spring 5 abuts against the linkage member 8; the supporting structure 9 is fixed to the linkage member 8; the damping structure 10, which is disposed in the housing 1, is supported by the supporting structure 9 and moves in the housing 1 along with the supporting structure 9; a piston rod 101 of the damping structure 10 can abut against the torsion spring 5, thereby increasing the resetting resistance to the torsion spring 5.

During use, when the door is closed, the linkage member 8 rotates, and the supporting structure 9 moves along with the linkage member 8. Thus, the supporting structure 9 propels the damping structure 10 to move towards the direction of the torsion spring 5. The piston rod 101 of the damping structure 10 abuts against the torsion spring 5, thereby decreasing the resetting torque of the torsion spring 5. Consequently, the closing force of the door can be reduced and the closing speed can be lowered, thereby achieving a damping effect. Thus, the door plank can be slowly closed. When the door is open, the linkage member 8 moves towards a reverse direction, and the supporting structure 9 moves along the linkage member 8. The supporting structure 9 propels the damping structure 10 to move towards a direction far from the torsion spring 5. Consequently, the piston rod 101 of the damping structure 10 no longer abuts against the torsion spring 5. Thus, the torsion spring 5 works normally, and the door can be open.

In this embodiment, the supporting structure 9 comprises two left support arms 91 and two right support arms 92. The two left support arms 91 and the two right support arms are symmetrically disposed on the linkage member 8. The left support arm 91 coordinates with the corresponding right support arm 92, thereby forming a V-shaped mounting slot. The damping structure 10 is disposed in the V-shaped mounting slot formed between the left support arm 91 and the corresponding right support arm 92. During use, when the linkage member 8 rotates clockwise, the right support arm 92 abuts against the damping structure, and the supporting structure 9 moves leftward; when the linkage member 8 rotates counter-clockwise, the left support arm 91 abuts against the damping structure 10, and the supporting structure 9 moves rightward.

In this embodiment, the damping structure 10 is a round-shaped cylinder body. The two sides of the round-shaped cylinder body are respectively provided with a locking block 102. The locking block 102 is disposed in the mounting slot formed between the left support arm 91 and the corresponding right support arm 92.

The description of the above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A door hinge having a damping function, comprising:

a housing, a first rotating shaft, a second rotating shaft, a U-shaped rotating shaft, a hinge cup, a linkage member, a torsion spring, a connector, a supporting structure, and a damping structure comprising a damping housing and a piston rod, wherein a first end of the linkage member is rotationally provided on the housing by the first rotating shaft, and a second end of the linkage member is rotationally connected to the hinge cup by a first arm of the U-shaped rotating shaft, wherein the hinge cup is configured for fixing on a door plank, wherein a first end of the connector is rotationally provided on the housing by the second rotating shaft, and a second end of the connector is rotationally connected to the hinge cup by a second arm of the U-shaped rotating shaft, wherein the torsion spring is fitted over the second rotating shaft, a first end of the torsion spring is fixed to the linkage member, and a second end of the torsion spring abuts against the linkage member, wherein the supporting structure is fixed to the linkage member such that the supporting structure cannot move with respect to the linkage member, wherein the damping structure is supported by the supporting structure, wherein as the linkage member moves between an open and a closed position, the supporting structure causes the damping housing to slide along the housing between a first position in which the piston rod is separated from the torsion spring and a second position in which the piston rod is in contact with the torsion spring.

2. The door hinge having a damping function of claim 1, wherein the supporting structure comprises two left support arms and two right support arms, wherein each left support arm coordinates with a respective right support arm to form a V-shaped mounting slot, wherein a portion of the damping housing is disposed in the V-shaped mounting slot for sliding the damping housing along the housing.

3. The door hinge having a damping function of claim 2, wherein the damping housing has a round-shaped cylinder body, wherein the portion of the damping housing comprises a pair of locking blocks, wherein two sides of the round-shaped cylinder body are respectively provided with one of the locking blocks, wherein each locking block is disposed in the respective mounting slot.

* * * * *